US007493858B1

(12) United States Patent
Smith et al.

(10) Patent No.: US 7,493,858 B1
(45) Date of Patent: Feb. 24, 2009

(54) MEMS INERTIAL DELAY DEVICE

(75) Inventors: Gabriel L. Smith, Odenton, MD (US); Daniel J. Jean, Odenton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 280 days.

(21) Appl. No.: 11/040,291

(22) Filed: Jan. 6, 2005

(51) Int. Cl.
*F42C 15/34* (2006.01)

(52) U.S. Cl. ..... 102/222; 200/61.53; 73/514.38

(58) Field of Classification Search ..... 102/221–264; 73/514.38; 200/61.53
See application file for complete search history.

(56) References Cited

U.S. PATENT DOCUMENTS 2,651,993 A * 9/1953 Berzof et al. ..... 102/232
3,955,508 A * 5/1976 Will et al. ..... 102/216
4,099,466 A * 7/1978 Redmond et al. ..... 102/215
5,551,293 A * 9/1996 Boysel et al. ..... 73/514.14
5,705,767 A 1/1998 Robinson
6,064,013 A 5/2000 Robinson
6,167,809 B1 1/2001 Robinson et al.
6,314,887 B1 11/2001 Robinson
6,765,160 B1 7/2004 Robinson
7,051,656 B1 * 5/2006 Koehler et al. ..... 102/249

* cited by examiner

*Primary Examiner*—Andrew J. Fischer
*Assistant Examiner*—Jamie Kucab
(74) *Attorney, Agent, or Firm*—Fredric J. Zimmerman

(57) ABSTRACT

A MEMS inertial delay device having a substrate layer, an intermediate layer and a device layer. A plurality of freely moveable interlocking masses are formed in the device layer along with springs which connect the masses to first and second supports. Movement of a first one of the interlocked masses, due to a shock event, allows subsequent masses to move, with a last mass including an activation member, movement of which causes operation of a mechanism, such as movement of a lock in a safe/arm arrangement in a munition round.

10 Claims, 6 Drawing Sheets

MEMS INERTIAL DELAY DEVICE

STATEMENT OF GOVERNMENT INTEREST

The invention described herein may be manufactured and used by or for the Government of the United States of America for government purposes without the payment of any royalties therefor.

BACKGROUND OF THE INVENTION

Various scenarios exist where it is desirable to delay the initiation of an event until some time after an initial shock or acceleration. By way of example, in order to prevent premature detonation, many munition rounds, such as artillery shells, go through a multi-stage arming sequence after being fired. It is required that the sequence commence only after the shell has been fired, and for this purpose a delay after firing is imposed in the procedure.

One way of providing the necessary delay is by the use of an accelerometer. One problem with the accelerometer, however, is that it requires not only a power supply but a signal processor as well. Such arrangement needs a significant volume to package the necessary components, which is impractical for various situations, including use in a munition round.

The delay may also be accomplished by an inertial delay mechanism, one of which is known as a falling leaf delay mechanism comprised of a plurality of interlocking masses wherein a subsequent mass is prevented from moving until the previous mass has moved out of the way. The typical falling leaf delay mechanism is comprised of a first series of masses rotatable about a first post and a second series of masses, interlocked with the first series, rotatable about a second post. Each mass, except for the first, occupies a plane above a previous mass. When the mechanism is subjected to a shock, a first mass of the first series is moved out of position allowing a first mass of the second series of masses to move out of position. That is, movement of a mass allows the next interconnected mass to move out of position. A last of the masses to move includes an activation member to activate some event, the activation occurring after a time delay imposed by movement of the totality of all the masses, subsequent to the initial shock.

Existing falling leaf designs require masses, which are individually machined, followed by an assembly process. The required assembly is either by hand, a time consuming process, or by expensive machine placement. In addition, present designs are relatively large for placement in munition rounds and do not respond to relatively low acceleration environments.

It is an object of the present invention to provide an inexpensive miniature inertial delay device which can respond to low accelerations and which is fabricated utilizing MEMS (micro electromechanical systems) techniques.

SUMMARY OF THE INVENTION

A MEMS inertial delay device is provided which includes a substrate, an intermediate layer on the substrate, and a device layer on the intermediate layer. The device layer includes first and second spaced-apart support members secured to the substrate by the intermediate layer, and a plurality of interlocked masses, each connected to one of the first or second support members by a spring arrangement. The interlocked masses and the spring arrangement are devoid of any underlying intermediate layer so that the interlocked masses and the spring arrangement are freely moveable. The principles of the present invention may be applied to a free-standing inertial delay device which includes first and second spaced-apart support members with a plurality of interlocked masses, each connected to one of the first or second support members by a spring arrangement. The masses are all in the same plane and are positioned between the first and second support members.

BRIEF DESCRIPTION OF THE DRAWINGS

The invention will be better understood, and further objects, features and advantages thereof will become more apparent from the following description of the preferred embodiments, taken in conjunction with the accompanying drawings, in which.

DETAILED DESCRIPTION OF THE PREFERRED EMBODIMENTS

Figure 1A:
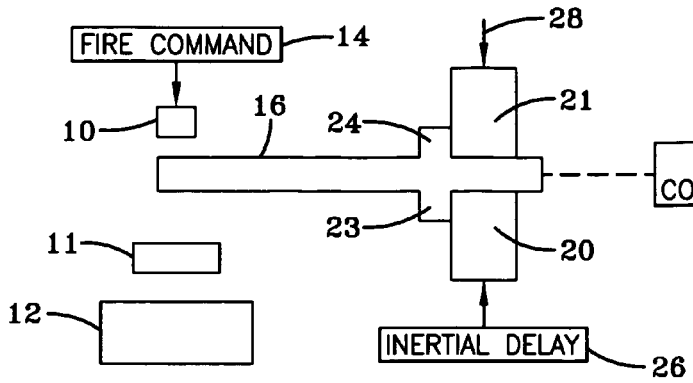
FIGS. 1A, 1B, and 1C conceptually illustrate an arming sequence for a munition round.

In the drawings, which are not necessarily to scale, like or corresponding parts are denoted by like or corresponding reference numerals.

Figure 1B:
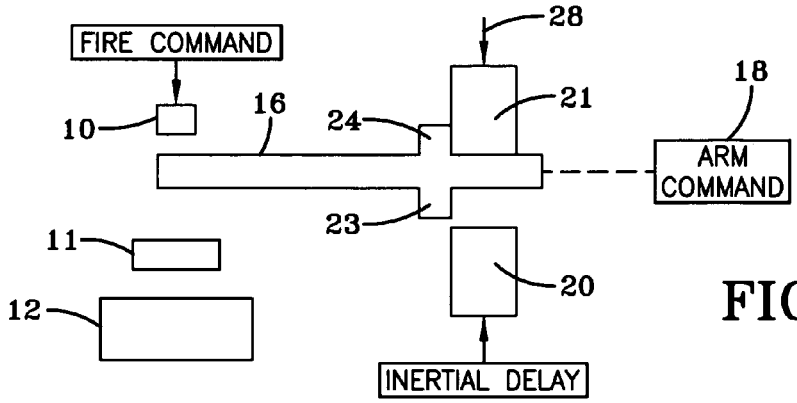
Figure 1C:
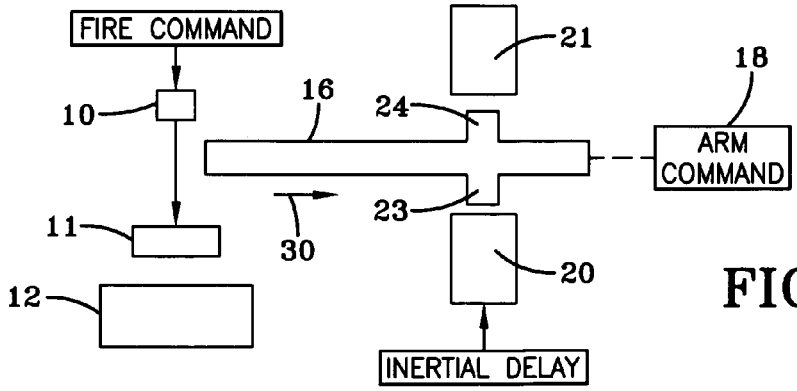

Although the present invention is applicable for use in a variety of situations, it will be described, by way of example, with respect to the arming of a munitions round, such as an artillery shell. FIGS. 1A, 1B and 1C conceptually illustrate the components and process involved. In FIG. 1A the artillery shell includes a primary charge 10, which, when detonated will activate a secondary charge 11, which, in turn, will set off a main charge 12. The explosive detonation is commenced by a fire command 14. The explosive train is interrupted however, by intervention of a barrier such as slider 16.

The slider 16 may move out of position to allow firing by means of an arm command 18, however the slider is constrained from movement by lock 20, and lock 21, acting as a back-up safety, engaging respective projections 23 and 24. Once lock 20 is moved out of position, lock 21 may thereafter may be moved out of position to allow slider 16 to move whereby detonation may subsequently take place. Lock 20 is moved out of position after a certain delay after the firing of the artillery shell, and the lock movement is accomplished by an inertial delay device of the present invention.

After lock 20 is moved out of the way, as illustrated in FIG. 1B, lock 21 may then next be removed. Arrow 28 represents activation for moving lock 21 and may include such devices as a timer, an airflow sensor or even another inertial delay device, by way of example. In FIG. 1C both locks 20 and 21 are out of their initial position thereby unblocking projections 23 and 24 thus allowing arm command 18 to move slider 16 to move in the direction of arrow 30. Fire command 14 is then free to initiate the explosive portion of the sequence, such as upon target impact, or upon a predetermined delay after impact.

Figure 2:
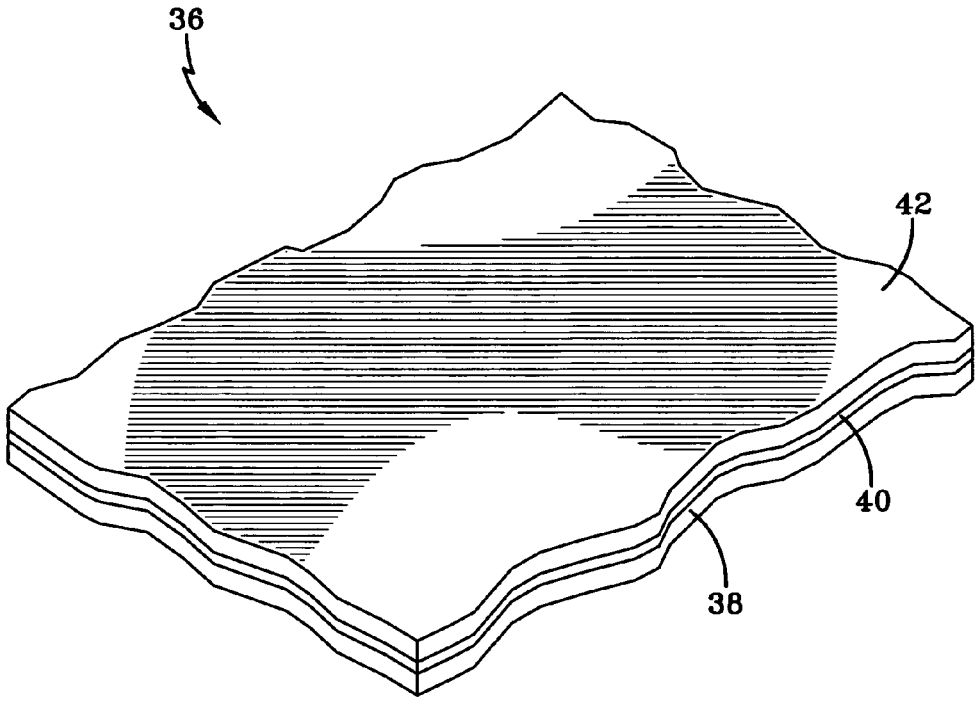
FIG. 2 is a view of a SOI (silicon on insulator) wafer prior to fabrication of the inertial delay device.

FIG. 2 illustrates a portion of an SOI wafer 36 from which the inertial delay device of the present invention will be fabricated. The structure of FIG. 2 includes a silicon substrate 38 (also known as a handle layer) covered by an insulating, or intermediate layer 40, such as silicon dioxide, over which is deposited another silicon layer 42, also known as the device layer, which is the layer from which the inertial delay device will be fabricated.

Figure 3:
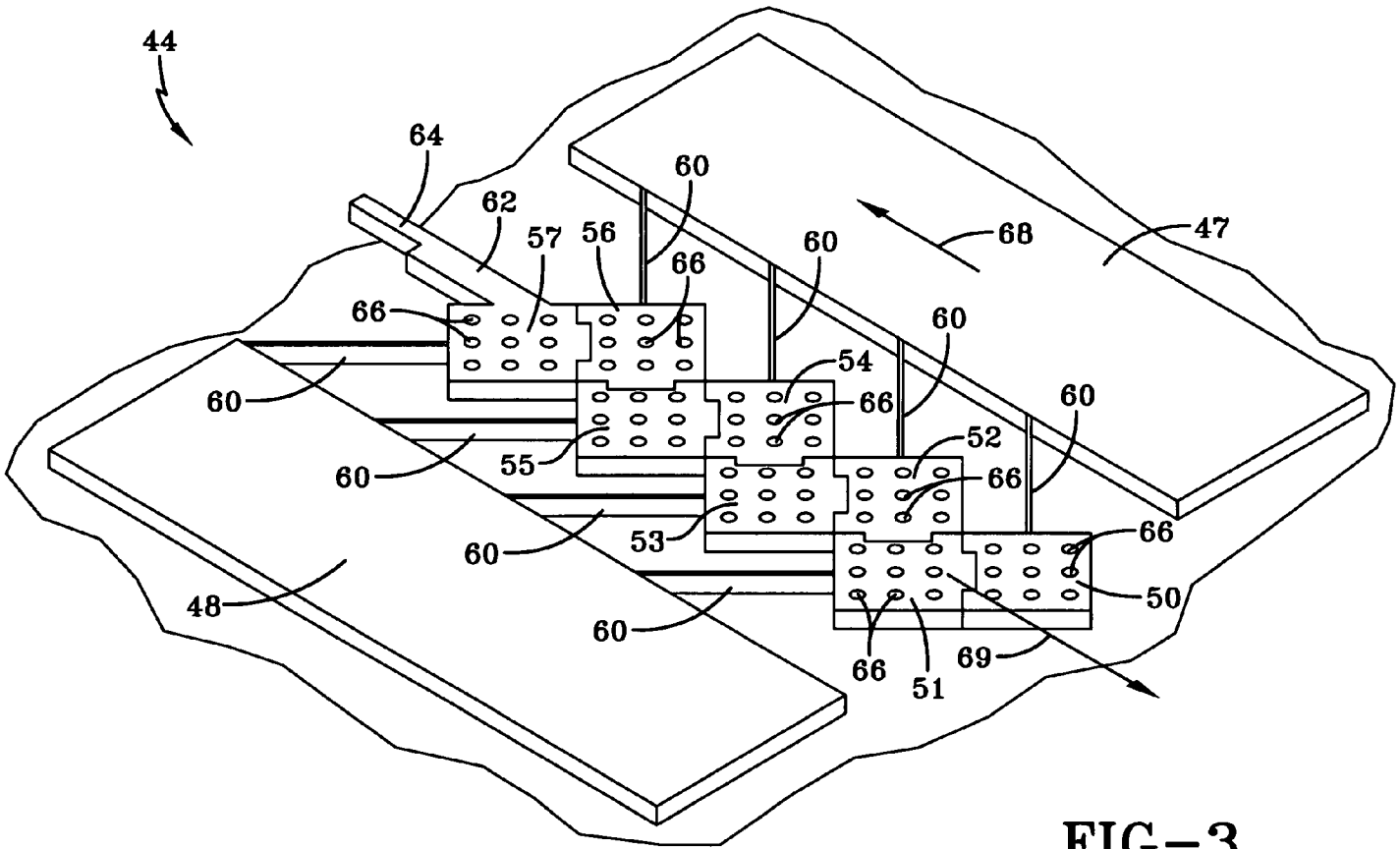
FIG. 3 is a perspective view of one embodiment of a fabricated inertial delay device in a locked condition.

FIG. 3 is a view of an inertial delay device 44, of a falling leaf design, formed from the wafer 36 of FIG. 2. The inertial delay device is formed by a DRIE (deep reactive ion etching) process, which removes unwanted portions of device layer 42. The DRIE process is a well developed and known micromachining process used extensively with silicon based MEMS (micro electromechanical systems) devices. For this reason silicon is the preferred material for the inertial delay device of the present invention, although other materials are possible.

Inertial delay device 44 is one of a multitude of identical inertial delay devices fabricated on the same wafer 36, with all of the inertial delay devices being separated after fabrication for use as individual inertial delay devices. As illustrated in FIG. 3, inertial delay device 44, etched in the device silicon layer 42 includes first and second spaced-apart supports 47 and 48. Each of a plurality of interlocked masses 50 to 57, all in the same plane, is connected to one of the supports 47 or 48 by a spring arrangement, which, in the embodiment of FIG. 3 consists of a single spring 60.

The last mass 57 includes an extension 62 which functions to move an activator 64 which is connected to the first lock 20 in FIG. 1 (or to any other mechanical or electrical mechanism for which delayed operation is desired). In order to operate as an inertial delay device, masses 50 to 57, as well as springs 60 must be free to move and therefore must be free of any underlying silicon dioxide insulating layer 40. One way to accomplish the removal of the underlying insulating layer is by applying an etchant, such as, hydrofluoric acid, which will dissolve the silicon dioxide.

The etchant will, in a relatively short period of time, dissolve the insulation beneath the springs 60, since they are of small width, thus freeing them for movement. In order to shorten the time for dissolving the silicon dioxide under masses 50 to 57, they are provided with a series of apertures 66 which extend from the top surface down to the insulating layer 40, thereby allowing the etchant direct access to the undersurface of the masses. Although some of the etchant dissolves the insulation under the supports 47 and 48, the process of freeing the masses 50 to 57 and springs 60 is completed before the supports are completely freed so that they remain immovable.

Figure 4:
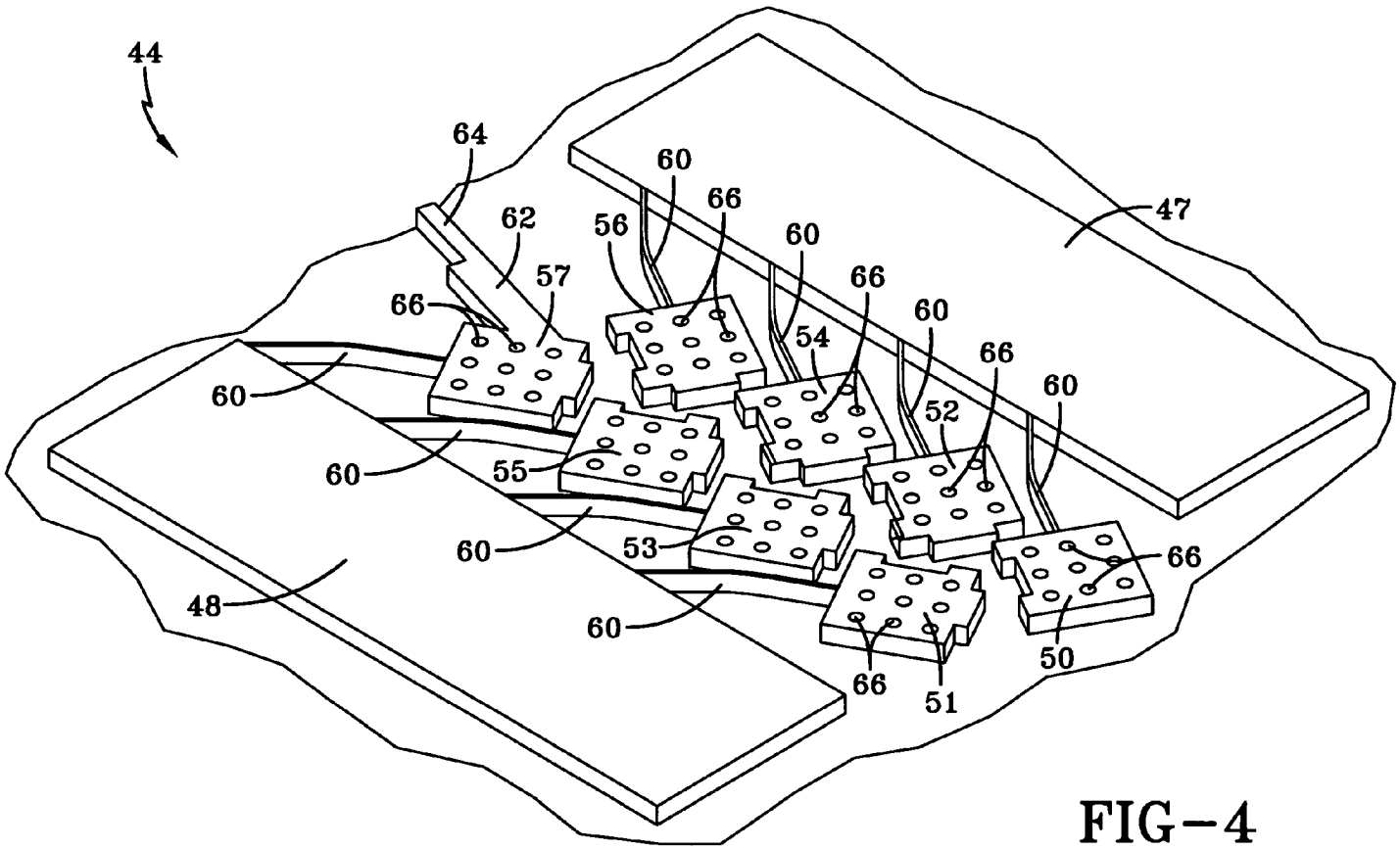
FIG. 4 is a perspective view of the fabricated inertial delay device of FIG. 3 in an unlocked condition.

In response to an initial shock in the direction of arrow 68, the first mass 50 will move out of position, in the direction of arrow 69. This movement frees the second mass 51 for movement and the process is repeated until all the masses 50 to 57 are unlocked, as in FIG. 4. Movement of the last mass 57 together with extension 62 and activator 64 therefore moves lock 20 out of the way at a time subsequent to the shock causing event. This time delay may, by way of example, be on the order of a fraction of a second up to several seconds. Thus, a shock event such as a dropping of the artillery shell, lasting a period of time measurable in milliseconds will not cause a removal of the lock.

Figure 5:
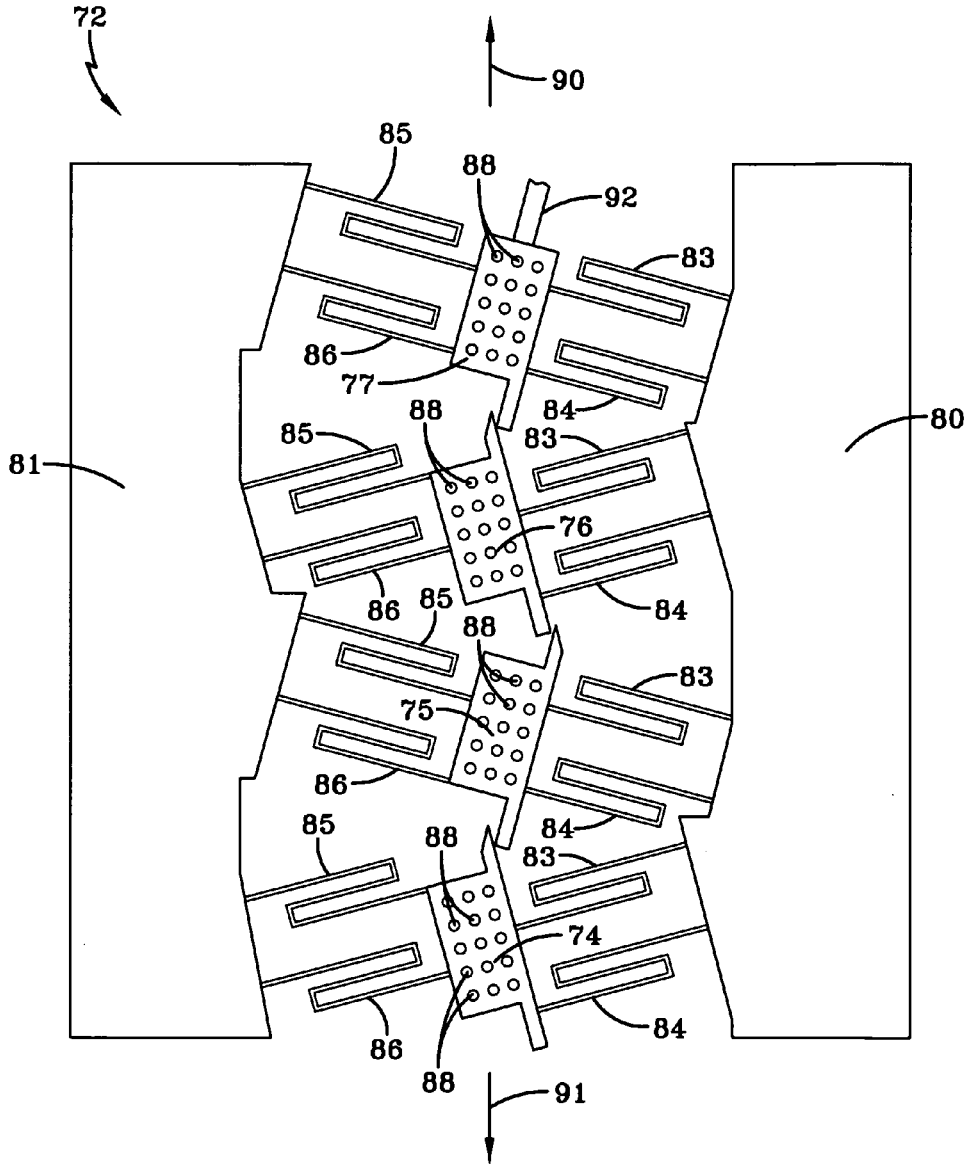
FIG. 5 is a plan view of another embodiment of a fabricated inertial delay device in a locked condition.

FIG. 5 is a plan view of another embodiment of the present invention. Inertial delay device 72 includes four interlocked masses 74 to 77, each being connected to both supports 80 and 81 by a spring arrangement. More particularly, the spring arrangement is comprised of springs 83 and 84 connecting a respective mass 74 to 77 to first support 80, and springs 85 and 86 connecting a respective mass 74 to 77, to second support 81. Each spring 83 to 86 is of a serpentine shape and, in particular, the serpentine shape is a substantially "S" shape, including two (2) curves, to give flexibility to the springs. As is the case with respect to masses 50 to 57 of FIG. 3, masses 74 to 77 include a series of apertures 88 to facilitate the etchant removal of underlying insulating material during the fabrication process.

Figure 6:
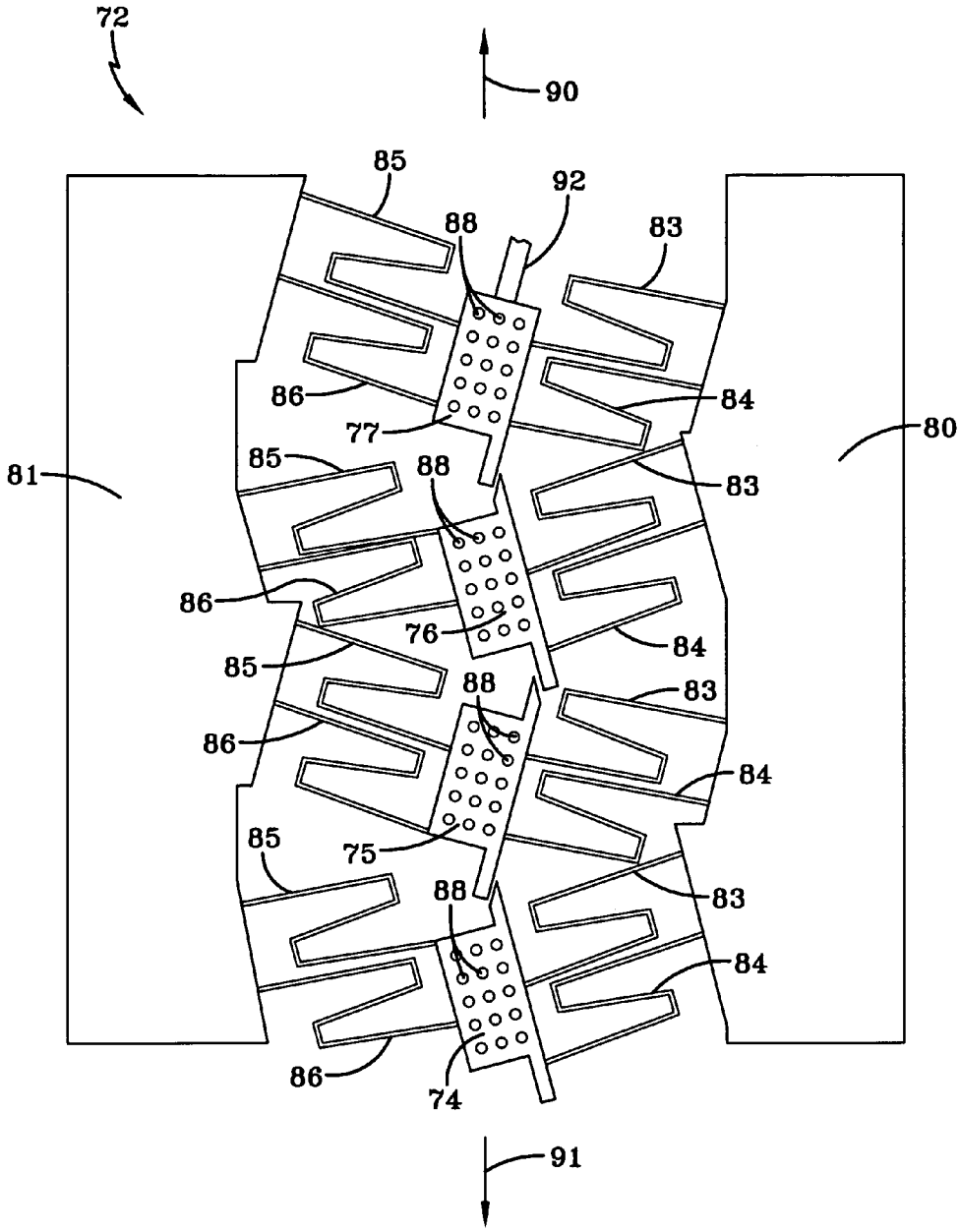
FIG. 6 is a perspective view of the fabricated inertial delay device of FIG. 5 in an unlocked condition.

In the absence of any shock, mass 74 remains immobile and prevents movement of the subsequent masses 75 to 77. If the device is subject to a shock in the direction of arrow 90, mass 74 will move in the direction of arrow 91, thus freeing the remaining masses for movement. The last mass 77 includes an activator 92 for operating a mechanism, such as the removal of a lock, as previously described. The unlatched condition of the inertial delay device 72 is illustrated in FIG. 6.

It will be readily seen by one of ordinary skill in the art that the present invention fulfills the objects set forth herein. After reading the foregoing specification, one of ordinary skill in the art will be able to effect various changes, substitutions of equivalents and various other aspects of the present invention as broadly disclosed herein. It is therefore intended that the protection granted hereon be limited only by the definition contained in the appended claims and equivalents. Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. A MEMS inertial delay device, comprising:

a substrate;

an intermediate layer on said substrate; and a device layer on said intermediate layer;

said device layer including, first and second spaced-apart support members secured to said substrate by said intermediate layer, and a plurality of interlocked masses, each mass connected to one of said first and second spaced-apart support members by a spring arrangement, wherein said plurality of interlocked masses and said spring arrangement are devoid of any underlying intermediate layer so that said plurality of interlocked masses and said spring arrangement are freely moveable.

2. The device according to claim 1, wherein a last mass of said plurality of interlocked masses includes an activation member coupled to it, wherein subsequent masses of said plurality of interlocked masses are sequentially moveable out of position in response to movement of a previous mass of said plurality of masses, and wherein said activation member is operable to operate a predetermined mechanism after a time delay, which commences with movement of said first mass.

3. The device according to claim 1, wherein said spring arrangement consists of a single spring member, which contacts and connects said each mass to one of said first support member and said second support member.

4. The device according to claim 1, wherein said each mass is connected to one of the first support member by a first spring arrangement and the second support member by a second spring arrangement, wherein the first spring arrangement is comprised of a first spring member and a second spring member, and wherein the second spring arrangement is comprised of a third spring member and a fourth spring member.

5. The device according to claim 1, wherein said substrate and said device layer each comprise silicon, and wherein said intermediate layer comprises silicon dioxide.

6. The device according to claim 1, wherein said plurality of interlocked masses comprises a first directional shock activated mass.

7. The device according to claim 1, wherein said spring arrangement comprises a plurality of springs, said plurality of springs comprise serpentine shaped springs.

8. The device according to claim 1, wherein subsequent masses of said plurality of interlocked masses are sequentially moveable out of position in response to movement of a previous mass of said plurality of masses.

9. The device according to claim 1, wherein said each mass comprises a plurality of apertures.

10. The device according to claim 1, wherein a last mass of said plurality of interlocked masses comprises an activation member coupled to it, and wherein said activation member operates a predetermined mechanism after a time delay, which commences with movement of a first mass of said plurality of said interlocked masses.

* * * * *